United States Patent [19]

Reifschneider

[11] Patent Number: 4,738,593

[45] Date of Patent: Apr. 19, 1988

[54] CENTRIFUGAL BLOWER WHEEL

[75] Inventor: Alan P. Reifschneider, Parma Heights, Ohio

[73] Assignee: Philips Industries Inc., Dayton, Ohio

[21] Appl. No.: 871,237

[22] Filed: Jun. 6, 1986

[51] Int. Cl.[4] ..... F04D 29/18; F03B 3/12; F03D 11/00

[52] U.S. Cl. ..... 416/178; 29/156.8 CF; 416/187

[58] Field of Search ..... 416/178, 184, 187, 199; 29/156.8 CF

[56] References Cited

U.S. PATENT DOCUMENTS 2,495,855 1/1950 Marcoe ..... 29/156.8 CF
2,537,805 1/1951 Wilken ..... 416/178
2,714,485 8/1955 Goettl ..... 418/187

FOREIGN PATENT DOCUMENTS 0459563 9/1949 Canada ..... 416/178

*Primary Examiner*—Mark Rosenbaum
*Assistant Examiner*—Taylor J. Ross
*Attorney, Agent, or Firm*—Biebel, French & Nauman

[57] ABSTRACT

A centrifugal blower wheel consisting of a wire hoop, a disk member and a plurality of separate blower blades arranged about the periphery of the wheel are operatively connected to the hoop and the disk member by a flange formed on each end of the blades. The flanges are rolled around the hoop, hoops or hoop and disk member such that the blades are operatively spaced around the periphery of the wheel.

6 Claims, 2 Drawing Sheets

CENTRIFUGAL BLOWER WHEEL

BACKGROUND OF THE INVENTION

This invention relates to centrifugal blowers, and more particularly to an improved end construction for blower wheels and improved methods for both the manufacture and assembly thereof. More specifically, the invention relates to improvements in both the structure and method of manufacturing and assembling a blower wheel which reduce the amount of material required to construct the wheel and simplify the assembly operation while retaining the performance parameters of blower wheels manufactured and assembled by less efficient methods.

Blower wheels and methods of their assembly are well known in the art with a wide variety of blowers being commercially available. An example of a commercial blower wheel and its method of manufacture and assembly is disclosed in Wilken U.S. Pat. No. 2,537,805 commonly owned with the present application. In this patent, a plurality of blower blades are produced separately from a sheet of material. These blades have specifically configured flanges on their ends over which are folded end rings on the opposite ends of a double inlet blower wheel or at the open end of a single inlet blower wheel for securing the blades to the end rings.

An alternate method of constructing a blower wheel is disclosed in Wilken U.S. Pat. No. 2,628,419, also commonly owned with the present application, which discloses a blower wheel construction wherein the end rings have annular beads that are autogeneously welded to the ends of blades having straight outer edges. Further specific representative U.S. Patents disclosing blower wheel constructions and methods of manufacture and assembly include Wilken U.S. Pat. Nos. 2,651,830, 2,821,778 and 2,852,182, and Wentling U.S. Pat. Nos. 3,211,364, 3,165,258 and 3,253,318, all of which were owned by the predecessor of the assignee of the present invention.

In the past, blower wheel constructions and methods of manufacture and assembly, as disclosed above, have resulted in an uneconomical utilization of material in the form of scrap centers resulting from stamping of the sheet metal end rings utilized with those blower wheel constructions having end rings.

What is needed, therefore, is a blower wheel and a method of manufacture and assembly of blower wheels which will eliminate the scrap material produced by stamping the end rings from the material sheet, and which will simplify the assembly operation by assembling the blower wheel by means of assembly apparatus similar to that utilized in the assembly of a blower wheel having conventional sheet metal end rings. This is accomplished with the present invention by eliminating the end rings and replacing them with a pair of wire hoops for double inlet blower wheels, or a single wire hoop and a specially formed end member for single inlet blower wheels.

SUMMARY OF THE INVENTION

The present invention provides for replacing the end rings with wire hoops and/or a specially designed end disk member and one wire hoop, producing blades with a specially designed flange for securing the blade to the wire hoops and/or specially formed end disk member, and rolling the specially designed flanges around the hoops and/or the specially designed disk member from the outside to the inside utilizing some of the apparatus utilized with the old asssembly method for blowers having end rings while realizing a material savings in the elimination of the end rings. The flange rolling is accomplished by a specially designed punch which axially contacts and rolls the flanges into place around the wire hoop or specially designed disk member, and then locks the flanges thereto.

Specifically, the present invention provides a blower wheel and a method for manufacturing and assembling the blower wheel wherein the blower blades are secured to wire hoops and/or a specially designed disk member by utilizing specially formed flanges on each end of the individual blower blades. After the flange configuration is formed on each blade, a complete set of the blades is held in a jig and assembled onto the two end wire hoops for a double inlet blower, or one wire hoop and a specially designed end disk member for a single inlet blower, the wire hoops or hoop and end member are positioned inside the flanges, and thereafter a specially formed punch is forced axially against each end of the assembly to roll the flanges around the hoops from the outside to the inside of the wheel.

The primary object of this invention, therefore, is to provide an improved blower wheel which is simple and economical in construction, which can be made at less expense than wheels previously available, and which is of high strength and rigidity capable of operating with freedom from objectionable vibration and noise at high speeds, and to provide a method of manufacturing and assembling blower wheels which reduces the amount of sheet metal required and to provide a method of manufacture and assembly which simplifies the assembly operation.

Other objects and advantages of the invention will be apparent from the following description, the accompanying drawings and the appended claims.

DESCRIPTION OF THE PREFERRED EMBODIMENT

Figure 1:
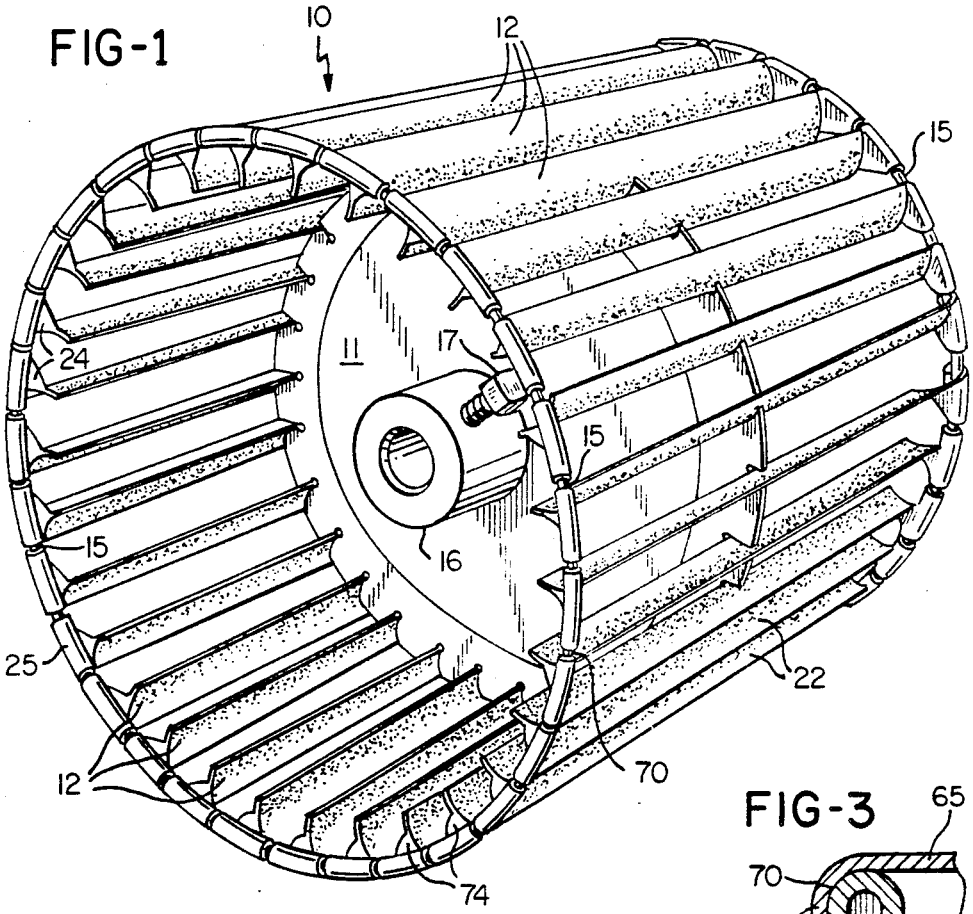
FIG. 1 is a perspective view of a double inlet blower wheel in accordance with the invention.

FIG. 1 shows a double inlet blower wheel 10 constructed in accordance with the invention. The individual components of this wheel are the center disk 11, the multiple individual blades 12 arranged circumferentially around the center disk 11, and at each end of the wheel, an end ring 15 which is a simple wire hoop of circular section. The center disk 11 may be of any suitable type and is shown as of the construction disclosed in Wilken U.S. Pat. No. 2,852,182. It includes the usual hub 16 and set screw 17 for mounting the wheel on a drive shaft.

The primary novelty and advantages of the present invention relate to the wire end rings 15 and the features of blade configuration and fabrication which make possible the use of these wire end rings. Each blade 20 is initially stamped from sheet metal and formed to provide a working face 22 of the desired dimensions and curvature. In its flat "stretchout" condition shown in FIG. 6, the blade has at each end an extension which is divided by a fold line 23 into a web 24 directly connected with the end of the blade and of generally triangular shape, and a generally rectangular flange 25 at the outer end of the extension. The web 24 is essentially a right triangle with the smaller of its acute angles being approximately 30° and being defined by its hypotenuse 23 and the fold line 26 along its connection with blade 22.

Figure 5:
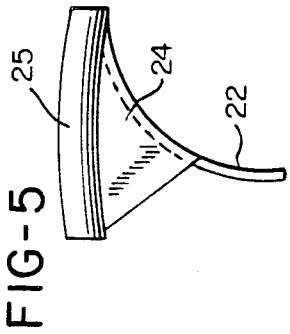
FIG. 5 is an end view on a larger scale of the blade shown in FIG 1.
Figure 4:
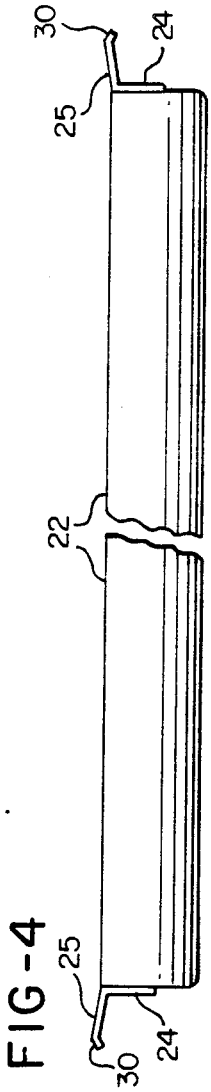
FIG. 4 is a side elevation of an individual blade for a blower wheel in accordance with the present invention prior to assembly in a wheel.

In the subsequent fabrication of the blade prior to its assembly in a wheel, the web 24 is bent at approximately right angles along the fold line 26 by which it is connected to the body of the blade and in the direction of the convex side of the blade, as best seen in FIG. 5. The flange 25 is initially bent along the fold line 23 through slightly less than 90°, as illustrated in FIG. 4, and the outer end portion of this flange is also bent along the line 27 parallel with the fold line 23 to provide a tip portion 30 which cooperates with the flange 25 to define a relatively large obtuse angle, e.g. 135°. During this fabricating procedure, the flange 25 is also curved to partial conformity with the curvature that it will assume in the completed wheel, as indicated in FIG. 5.

Figure 6:
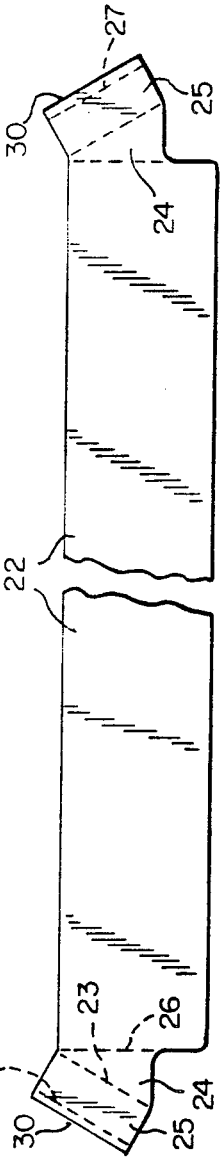
FIG. 6 is an elevation of the blade of FIG. 1 in "stretchout" form.

In the fabrication of a double inlet wheel as shown in FIG. 1 with a set of blades formed as described in connection with FIGS. 4–6, a full set of blades may first be assembled in a suitable jig such as is shown in a number of the above Wilken patents. As already noted, the end ring at each end of the wheel is a simple endless hoop 15 of wire of circular section, satisfactory results having been obtained with such wire of a diameter of 0.162 inch. The diameter of tne hoop is selected in accordance with the dimensions of the wheel, i.e., slightly less than the outer diameter of the blade portion of the wheel, so that it will fit snugly against the webs 24 inside the flanges 25 on the assembled set of blades, and the initial bending of flanges 25 through less than 90° is to open the cage which they define to an outer end diameter that will enable a ring 15 to be inserted therein.

Figure 8:
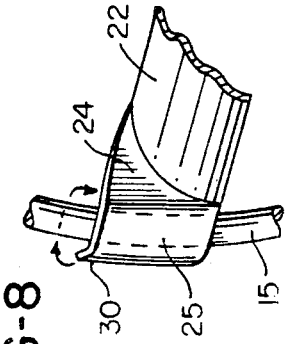
FIG. 8 is a fragmentary perspective view further illustrating the operation shown in FIG. 7.
Figure 7:
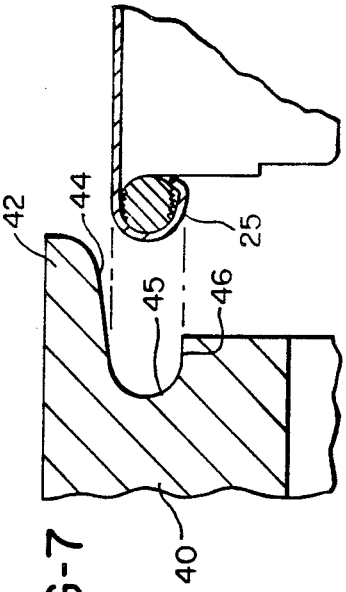
FIG. 7 is a fragmentary section illustrating the operation of securing a blade of the invention on a wire hoop end ring.

These flanges are then rolled inwardly of the wheel, as illustrated diagrammatically in FIG. 8, by means of a special punch 40 as illustrated in FIG. 7, preferably used in pairs operating from the opposite ends of the assembly of blades. This punch 40 includes a cylindrical ring 42 of a greater diameter than hoop 15, and having its radially inner surface 44 tapered inwardly from a maximum diameter greater than that of the hoop 15 to form a cavity 45 of internal dimensions which just match the dimensions of the hoop 15 with one of the flanges 25 rolled around it as shown in FIG. 7.

As each punch 40 is forced axially against the ends of the assembled blades as represented in FIG. 7, it will initially engage the tip portion 30 on each of the flanges 25 and force it radially and then axially inwardly of the wheel until the radially inner wall 46 of cavity 45 forces each flange to wrap around hoop 15 so that its bent tip portion 30 is tucked into the space between the hoop and the web portion 24 of the blade. The latter action and result constitute the reason for the preliminary bending of tip portion 30 about line 27.

Figure 10:
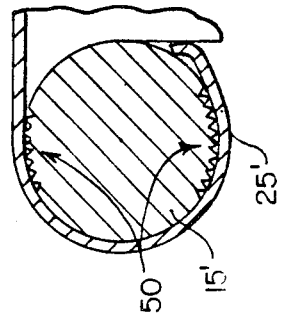
FIG. 10 is an enlarged diagrammatic view illustrating the interlocked connection between a knurled wire hoop end ring and blade in accordance with a modified form of the invention.

Test results indicate that this forming operation will result in causing each of the flanges 25 to grip the associated hoop 15 with sufficient firmness to hold all of the blades in the proper circumferentially spaced relation around the hoops 15 even if the number of blades is such that there are spaces between adjacent rolled flanges 25. If desired, however, the firmness of this gripping action can be increased if each of the hoops is subjected to a roughening operation, at least along its inner and outer diameter prior to assembly into the finished wheel. Such roughening is readily accomplished by running each hoop, or the wire from it is to be formed, through a pair of conventional knurling rolls to produce the knurled pattern indicated at 50 on the hoop 15′ in FIG. 10. When a hoop 15 is knurled in this manner, the forming operation illustrated in FIG. 7 results in having the roughness of the knurling dig into the flange 25′ as this flange is rolled around the hoop, thereby providing a positive lock against movement of the rolled flange lengthwise of the hoop.

Figure 3:
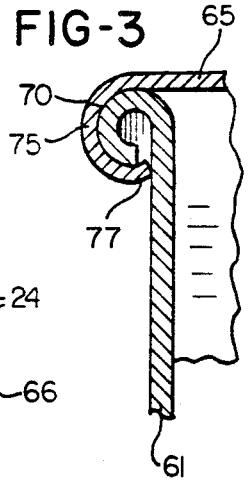
FIG. 3 is an enlarged fragmentary section on the line 3—3 in FIG. 2.
Figure 2:
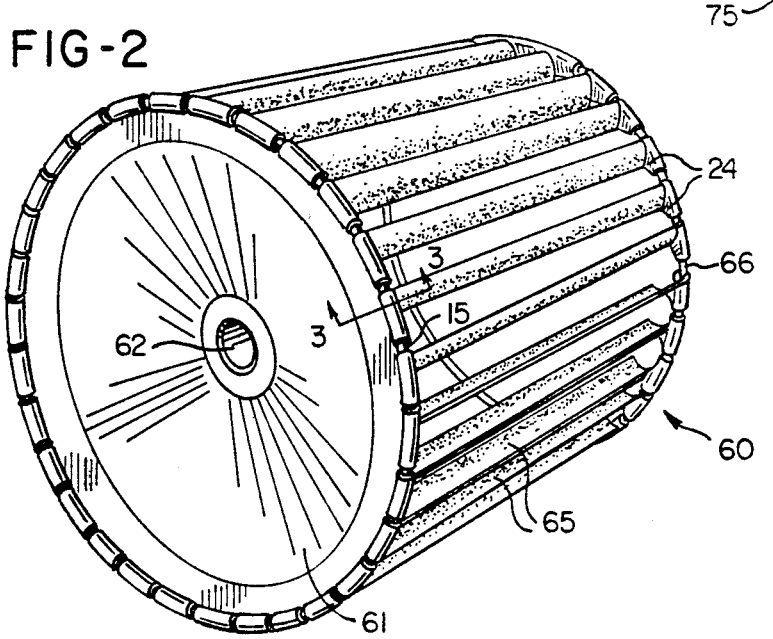
FIG. 2 is a perspective view of a single inlet wheel in accordance with the invention.

FIGS. 2 and 3 illustrate a single inlet blower wheel 60 constructed in accordance with the invention, which comprises an end disk 61 provided with the usual hub 62, multiple blades 65 and an end ring 66 that is a wire hoop just like the end ring hoops 15 as already described. The blades 65 are identical in configuration with the blades 20 as shown in FIGS. 4–6, but the end disk 61 is of special configuration dictated by the present invention.

Figure 9:
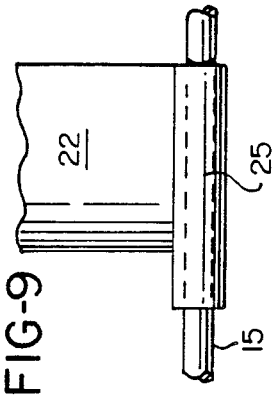
FIG. 9 is a fragmentary view showing the outside of one end of a blade following the operation shown in FIGS. 7–8.

Referring specifically to FIG. 9, the end disk 61 has its outer periphery rolled to a partially cylindrical configuration as shown at 70 in FIG. 3, with the outer radius of this cylindrical portion 70 matching the radius of the end ring 66 at the other end of wheel 60. With this configuration, fabrication of the blades 65 and assembly of the wheel is identical with the foregoing description in connection witn FIGS. 7 and 8, and it will result in providing the blade 65 with a web portion 74, flange portion 75 and tip portion 77 corresponding directly to the parts 24, 25 and 30 in FIGS. 6 and 7.

While the articles and method herein described constitute preferred embodiments of the invention, it is to be understood that the invention is not limited to these precise articles and method, and that changes may be made therein without departing from the scope of the invention which is defined in the appended claims.

What is claimed is:

1. A centrifugal blower wheel comprising a supporting disk, a plurality of individually separate blower blades arranged in circumferentially spaced relation around the periphery of said disk, and a supporting construction for the ends of said blades at one end of said wheel comprising:

(a) an endless wire hoop of an outer diameter less than the outer diameter defined by the blade portions of said wheel, (b) each said blade having at said end thereof a flange which extends axially therefrom into radially overlying relation with said hoop, and (c) all of said flanges being wrapped around said hoop to secure said blades to said hoop.

2. A blower wheel as defined in claim 1 wherein each said flange includes a tip portion which is bent with respect to the adjacent portion of said flange and thereby extends around said hoop into space between said hoop and the end of said blade.

3. A blower wheel as defined in claim 1 wherein at least a portion of the surface of said hoop is roughened to interlock with said rolled flange.

4. A blower wheel as defined in claim 1 wherein in the "stretchout" condition of each said blade, said end of said blade comprises a generally triangular web portion contiguous with said blade, and a flange portion connected with said web portion along a fold line defining an acute angle with the end of said blade whereby upon bending of said web portion about the connection thereof with said blade radially outwardly of said wheel, said flange portion may be bent around said fold line into radially overlying relation with said hoop.

5. A blower wheel as defined in claim 1 wherein said supporting construction is duplicated at opposite ends of said wheel and said supporting disk is located internally of said wheel to provide a double inlet blower wheel.

6. A blower wheel as defined in claim 1 wherein said supporting construction is located at only one end of the wheel, said supporting disk is located at the other end of the wheel to provide a single inlet blower wheel, and said disk further comprises an edge portion rolled to substantially the same cross sectional dimension as said hoop, each said blade having at the end thereof adjacent said disk a flange which extends axially thereof into radially overlying relation with said disk, and all of said flanges being wrapped around said rolled portion of said disk to secure said blades to said disk.

* * * * *